United States Patent [19]

Zifcak et al.

[11] Patent Number: 4,793,814

[45] Date of Patent: Dec. 27, 1988

[54] ELECTRICAL CIRCUIT BOARD INTERCONNECT

[75] Inventors: Mark S. Zifcak, Putnam; Bruce G. Kosa, Woodstock, both of Conn.

[73] Assignee: Rogers Corporation, Rogers, Conn.

[21] Appl. No.: 887,260

[22] Filed: Jul. 21, 1986

[51] Int. Cl.[4] ..... H01R 9/09

[52] U.S. Cl. ..... 439/66; 439/91

[58] Field of Search ..... 339/17 M, 59 M, 61 M, 339/DIG. 3; 264/272.15; 439/66–69, 71–75, 91, 591

[56] References Cited

U.S. PATENT DOCUMENTS

| | | | |
|---|---|---|---|
| 2,936,439 | 5/1960 | Murphy | 339/176 |
| 3,217,283 | 11/1965 | Shlesinger | 339/18 |
| 3,217,284 | 11/1965 | Shlesinger | 339/18 |
| 3,569,789 | 3/1971 | Jenik | 339/17 |
| 3,795,037 | 3/1974 | Luttmer | 339/59 M |
| 3,904,934 | 9/1975 | Martin | 339/17 M |
| 3,934,959 | 1/1976 | Gilissen | 339/17 M |
| 3,980,375 | 9/1976 | LaMarche | 339/61 M |
| 3,992,761 | 11/1976 | McElroy et al. | 264/272.15 |
| 4,003,621 | 1/1977 | Lamp | 339/59 M |
| 4,008,300 | 2/1977 | Ponn | 264/104 |
| 4,082,399 | 4/1978 | Barkhuff | 339/75 M |
| 4,150,420 | 4/1979 | Berg | 339/17 CF |
| 4,161,346 | 7/1979 | Cherian | 339/17 M |
| 4,199,209 | 4/1980 | Cherian | 339/59 M |
| 4,249,787 | 2/1981 | Welu | 339/64 R |
| 4,295,700 | 10/1981 | Sado | 339/61 M |
| 4,330,165 | 5/1982 | Sado | 439/91 |
| 4,367,908 | 1/1983 | Johnston | 339/154 A |
| 4,402,562 | 9/1983 | Sado | 339/61 M |
| 4,408,814 | 10/1983 | Takashi | 339/59 M |
| 4,445,735 | 5/1984 | Bonnefoy | 339/17 M |
| 4,509,099 | 4/1985 | Takamatsu | 361/413 |
| 4,593,961 | 6/1986 | Cosmo | 339/DIG. 3 |

FOREIGN PATENT DOCUMENTS 2024563 5/1970 Fed. Rep. of Germany .

*Primary Examiner*—Neil Abrams

[57] ABSTRACT

A connector arrangement for providing electrical interconnection between coresponding contact pads of opposed first and second circuit boards includes an electrically nonconductive support member disposed between the boards, a bodily-rotatable, electrically conductive interconnect element extending through the thickness of the support and having a pair of pad engagement surfaces disposed to engage the respective contact pads, and a clamp for retaining the circuit boards in a clamped-together relationship with the support member in a compressed, reduced thickness state and with the interconnect member bodily rotated. The support member includes resilient elastomeric material, has support surfaces respectively opposed to the board surfaces, and is adapted to be compressed by urging of the boards together. A line projected through the engagement surfaces at the time of their initial engagement upon the contact pads is disposed at an initial, acute angle to the direction of thickness of the support member, and, when being rotated, the same line lies at an acute angle to the direction of thickness of the support greater than the initial angle, the body of the support being locally deformed by the interconnect element and resiliently biasing the interconnect element towards its original position, into engagement with the pads.

20 Claims, 6 Drawing Sheets

Figure 1:
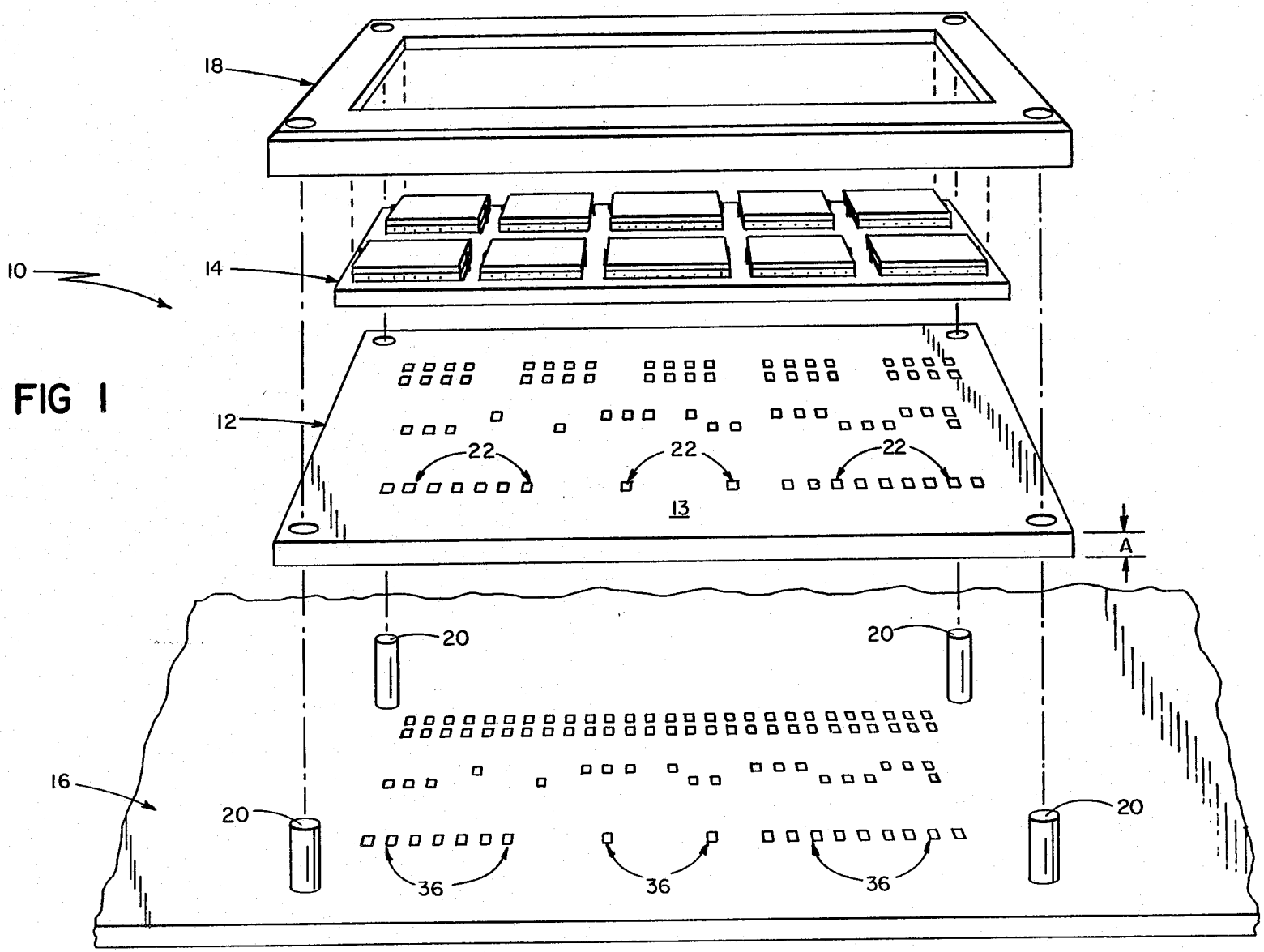

FIG 6
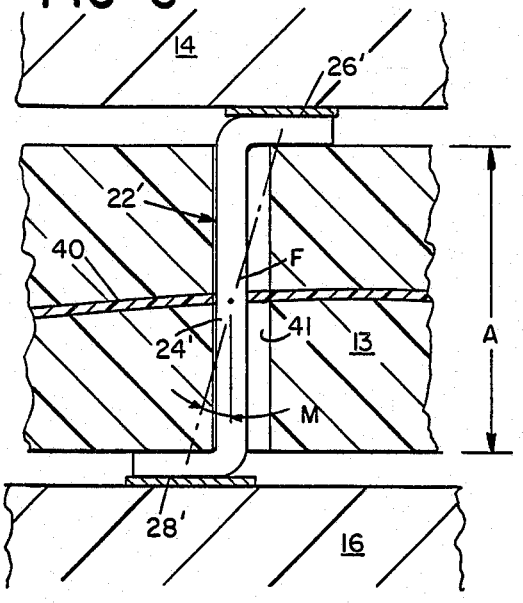
FIG 6a
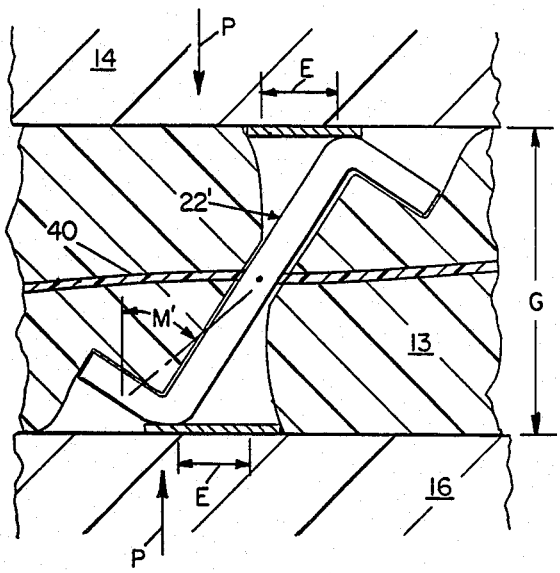
FIG 7
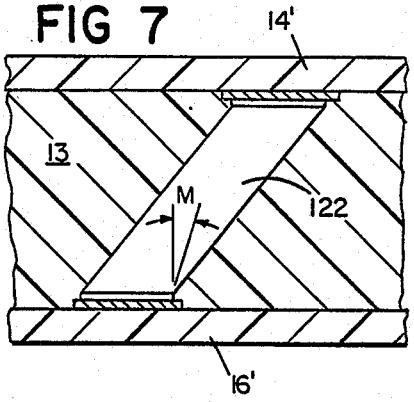
FIG 7a
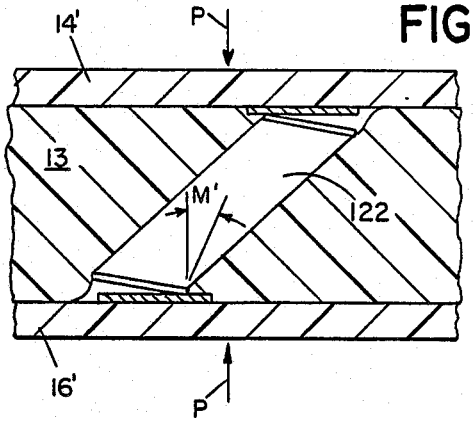
FIG 10
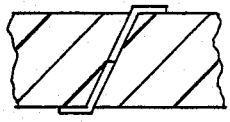
FIG 10a
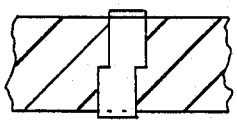
FIG 8
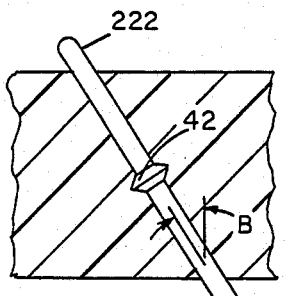
FIG 9
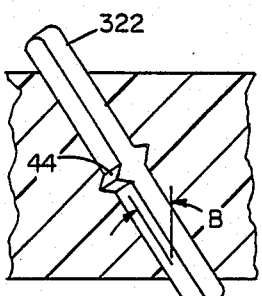
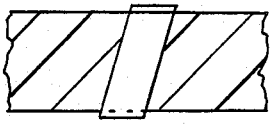
FIG 10b

ELECTRICAL CIRCUIT BOARD INTERCONNECT

This invention relates to devices for interconnecting contact pads of opposed circuit board surfaces.

Electrical interconnection between opposed circuits has, in the past, been provided by pin-and-socket engagement, e.g., as shown in Welu U.S. Pat. 4,249,787. It has also been known to provide interconnection via resilient conductors disposed in matrixes, including of foam or elastomer, e.g., as shown in Lamp U.S. Pat. No. 4,003,621, Luttmer U.S. Pat. No. 3,795,037, Sado U.S. Pat. No. 4,295,700, and Cherian et al. U.S. Pat. No. 4,161,346 and U.S. Pat. No. 4,199,209. It has also been suggested to employ connection devices consisting of a line of conductor sheets supported in a housing on elastically deformable rolls extending the length of the housing, as shown in Bonnefoy U.S. Pat. No. 4,445,735.

The objectives of the present invention include providing a connector arrangement having improvement in one or more of the following features: consistency of contact stresses during repeated connector compression/decompression cycles, minimal deformation of the connector element, simplicity of design, predictability of the effect of temperature and time on performance, and contact pad wiping during compression.

SUMMARY OF THE INVENTION

According to the invention, a connector arrangement for providing electrical interconnection between a first contact pad on a surface of a first circuit board and a corresponding second contact pad on an opposed surface of a second opposed circuit board comprises an electrically nonconductive support member disposed between the circuit boards and comprising resilient elastomeric material, the support member having support surfaces respectively opposed to the surfaces of the first and second circuit boards and being adapted to be compressed by urging of the circuit boards together, a bodily-rotatable, electrically conductive interconnect element extending through the thickness of the resilient support member and having a pair of pad engagement surfaces disposed to engage the respective contact pads of the circuit boards, a line projected through the engagement surfaces, at the time of their initial engagement upon the first and second contact pads, being disposed at an initial, acute angle to the direction of thickness of the support member, means for retaining the circuit boards in a clamped-together relationship with the support member in a compressed, reduced thickness state and with the interconnect member bodily rotated whereby the line projected through the engagement surfaces lies at an acute angle to the direction of thickness of the support member greater than the initial angle, the body of the support member being locally deformed by the interconnect element and resiliently biasing the interconnect element towards its original position, into engagement with the pads.

In preferred embodiments, the circuit boards carry a multiplicity of matching contact pads in a predetermined pattern corresponding to the arrangement of circuits on the boards, and the support member includes a corresponding multiplicity of the interconnect elements, the elements each being bodily rotated in response to the clamped-together relationship of the circuit boards, locally deforming the compressed support member and being resiliently biased against the respective contact pads by the support member, preferably the support member is of sheet form having inserted therein a multiplicity of the interconnect elements in a pattern corresponding to the pattern of the pads; the support member includes a distribution of voids that serve locally to accommodate the bodily rotation of the interconnect elements, preferably the support member comprises a layer of elastomeric foam, and the foam has an aggregate void volume in the range of about 25 to 95%, preferably in the range of about 60 to 75%; the elastomer is selected from the group consisting of silicone, urethane, natural rubber, copolymers of butadiene-styrene, butadiene-acrylonitrile, butadiene-isobutylene, chloroprene polymers, polysulfide polymers, plasticized vinyl chloride and acetate polymers and copolymers; the support member has a compression force deflection (CFD) in the range of about 2 to 50 pounds per square inch at 25 percent compression; the support member has a compression set of less than about ten percent after 22 hours at 158° F. at 50 percent compression, with one half hour recovery; the support member comprises an elastomeric foam sheet comprised of substance selected from the group consisting of silicone, urethane, natural rubber and the other materials mentioned above; the interconnect element comprises a body extending generally in the direction of thickness of the support member and end portions projecting from the respective ends of the body in a direction overlying the respective contact pads, preferably the interconnect element is generally of S-shape, and lines of projection of the end portions lie in a common plane normal to the direction of thickness of the support member, and the support member further comprises a sheet-form layer of generally non-distendable material disposed generally parallel to the opposed board surfaces.

Other features and advantages of the invention will be understood from the following description of the presently preferred embodiment, and from the claims.

PREFERRED EMBODIMENT

Figure 1A:
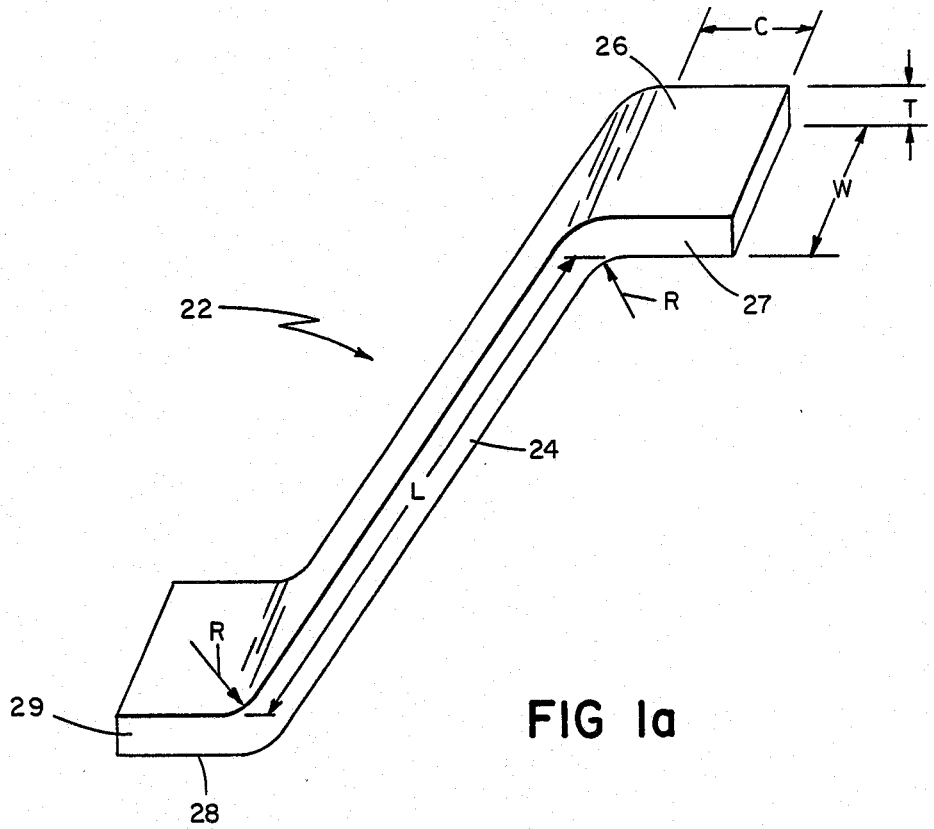
Figure 11:
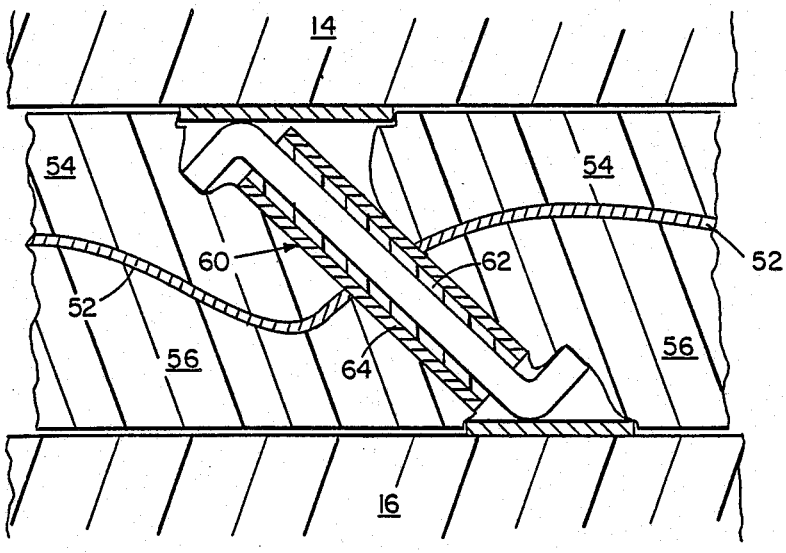
Figure 11A:
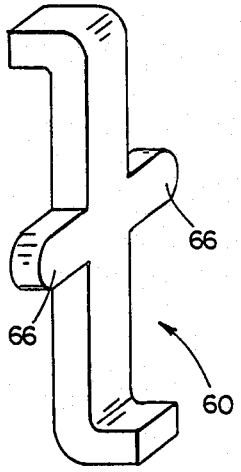
Figure 2:
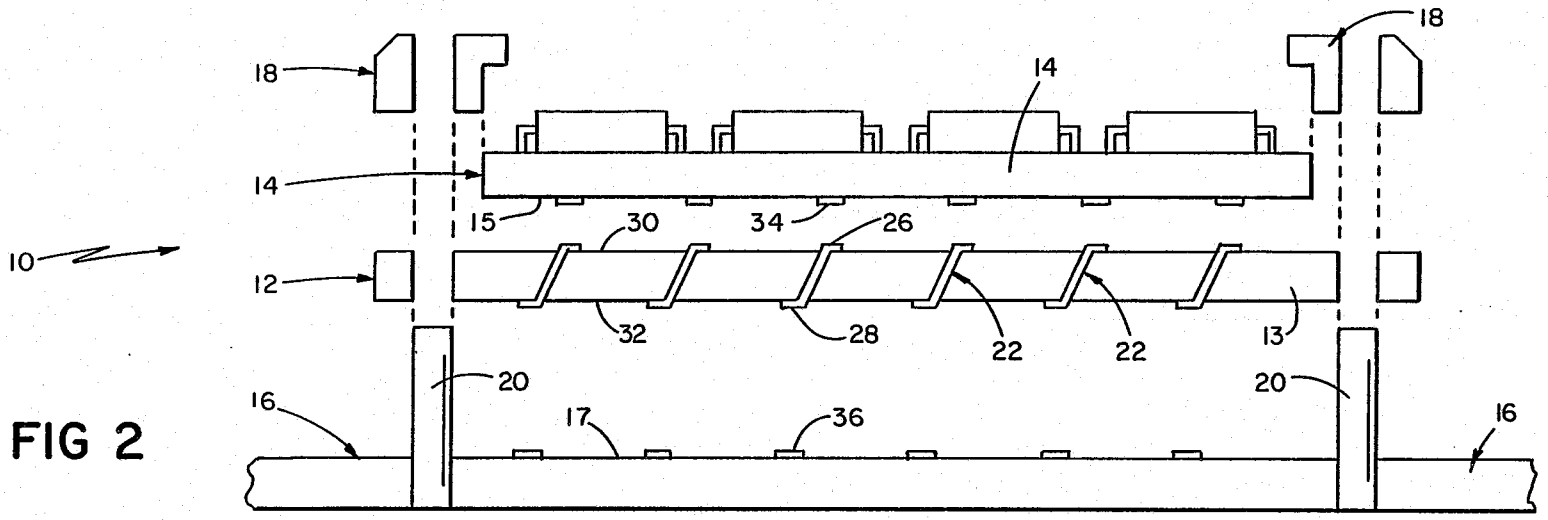
Figure 3:
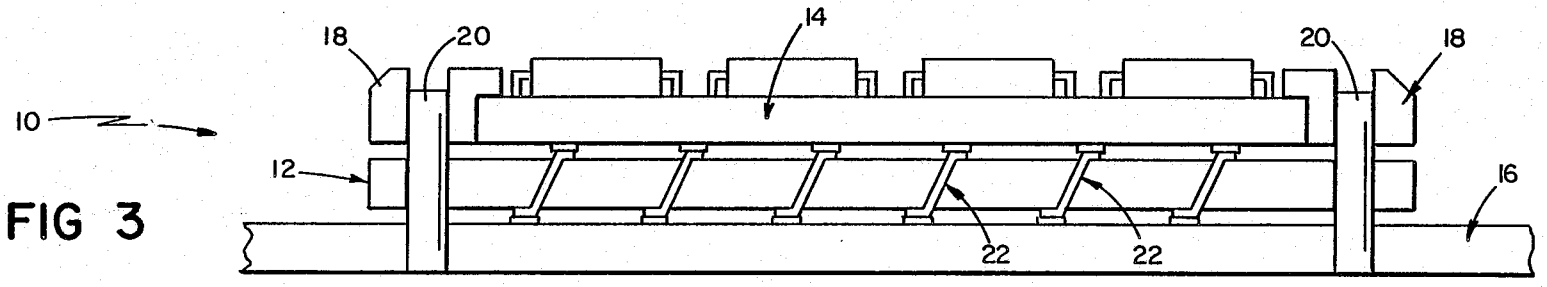
Figure 4:
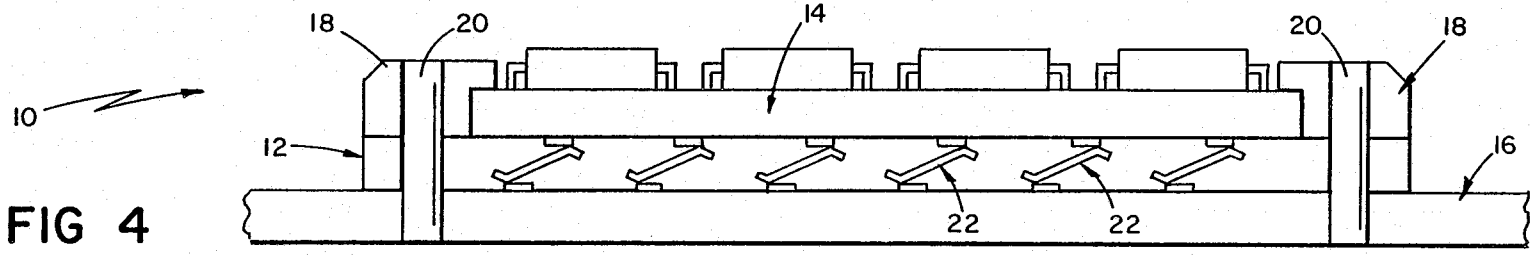
Figure 5:
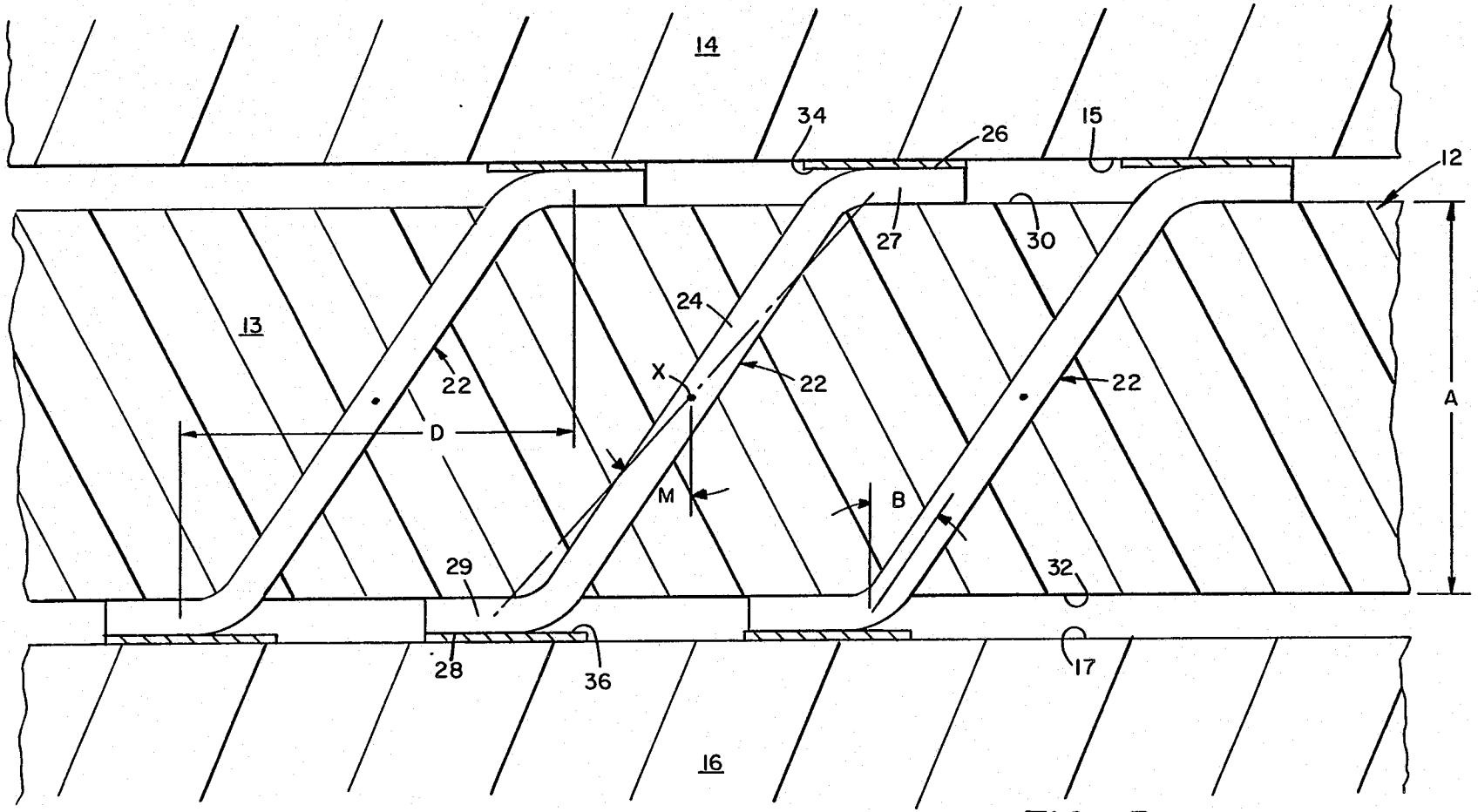
Figure 5A:
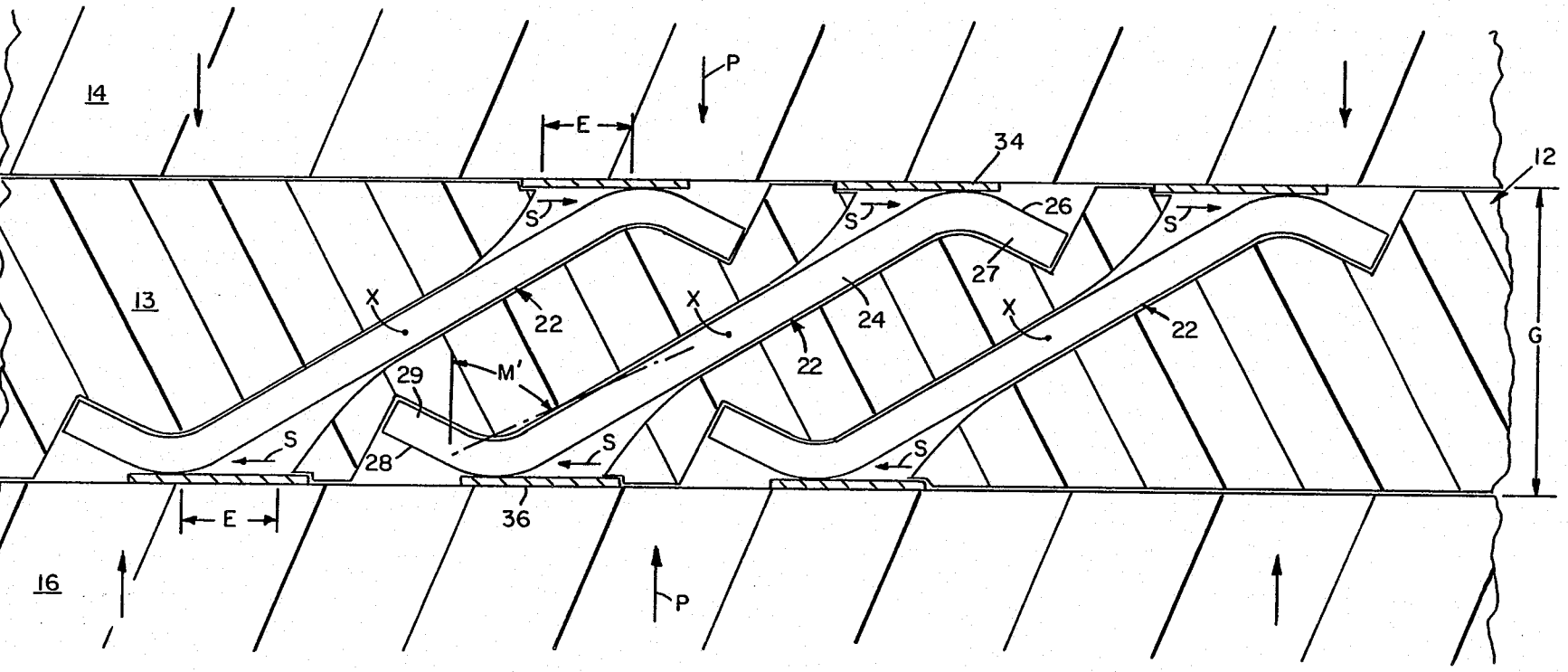

We first briefly describe the drawings:

FIG. 1 is an exploded view in perspective of a circuit including a preferred embodiment of the connector arrangement of the invention;

FIG. 1*a* is an enlarged perspective view of a preferred embodiment of the interconnect element in the connector arrangement of FIG. 1;

FIGS. 2, 3 and 4 are somewhat diagrammatic side section views of the circuit of FIG. 1, respectively showing the circuit in exploded, assembled and compression states;

FIGS. 5 and 5*a* are enlarged side section views of the circuit of FIG. 1 showing a 3-interconnect element segment in assembled and compression states;

FIGS. 6 and 6*a* are side section views of an alternate embodiment showing a one-interconnect element segment in the assembled and compression states, while FIGS. 7 and 7*a* are similar views of another alternate embodiment of the interconnect element;

FIGS. 8 and 9 are side section views, and FIGS. 10 and 10*a* are side and rear section views of still other alternate embodiments of the interconnect element, while FIG. 10*b* is rear section view of another alternate embodiment of the interconnect element having a front view as seen in FIG. 10; and FIG. 11 is a side section view of an alternate embodiment of the connector arrangement of FIG. 1 for low impedance connection, and FIG. 11*a* is a perspective view of the interconnect element of the device of FIG. 11.

Referring to FIG. 1, the electrical circuit 10 consists of connector arrangement 12 disposed between first and second electrical circuit boards 14, 16. Clamping frame 18 is provided for fixed assembly of the circuit over alignment posts 20.

Area array connector arrangement 12 consists of a sheet-form support member 13 of planar expanse, having uncompressed thickness, A, e.g., between about 0.025 inch an 0.500 inch, and preferably about 0.125 inch, including resilient, electrically nonconductive elastomeric material in the form of open cell foam having a density in the range of about 2 to 50 lbs/ft$^3$, preferably about 15 to 25 lbs/ft$^3$ (compared to a material density of about 65 lbs/ft$^3$), for an air or cell volume in the range of about 25% to 95%, preferably about 60 to 75%.

The support member has a characteristic compression force deflection (CFD) in the range of 2 to 50 lbs per square inch at 25 percent compression, and has a compression set, tested by ASTM Test Standard D 3574, of less than 10% compression set after 22 hours at 158° F. at 50% compression with one-half hour recovery. The foam material of support member 13 is preferably urethane, silicone or natural rubber, although the specific material employed is less critical than the physical characteristics mentioned above, and other suitable materials may also be employed, e.g., copolymers of butadiene-styrene, butadiene-acrylonitrile, butadiene-isobutylene, chloroprene polymers, polysulfide polymers, plasticized vinyl chloride and acetate polymers and copolymers. Where the elastomeric foam material is urethane, the average void diameter is of the order of about 125 microns.

Area array connector 12 also consists of a multiplicity of interconnect elements 22, disposed in the support member 13, and positioned selectively in the plane of the connector array, with element body 24 extending through the support member to expose contact pad engagement surfaces 26, 28 adjacent connector array surfaces 30, 32. The relative positions of the engagement surfaces are predetermined to correspond, when assembled, to the positions of contact pads on the opposed circuit board surfaces. Referring to FIG. 1*a*, in the preferred embodiment, generally S-shape interconnect element 22 consists of body 24 and tabs 27, 29 of electricity-conducting material, e.g., copper or other metal or metal-coated resin (provided the volume of metal is sufficient for the desired level of conductance, typically less than 1 ohm for power applications and less than 25 milliohms for signal applications). When disposed in the support member in the assembled, uncompressed state, body 24 preferably lies at acute angle B, to the direction of thickness of the support member (the normal line between surfaces 30, 32), angle, B, being in the range of about 0° to 70°, preferably about 20° to 40° and optimally about 30°. Angle, M, taken between a line projected through the engagement surfaces at the time of their initial engagement upon the contact pads and the direction of thickness, is somewhat greater where the tabs extend generally parallel to the overlying contact pad surfaces. Element 22 has width, W, selected to be in the range of 10 to 90% of contact pad spacing, thickness, T, selected to be in the range of about 10 to 100% of interconnect element width, preferably between about 0.250 inch down to 0.003 to 0.005 inch, or 0.001 inch, and length, L, selected to extend at angle B generally through the support member between surfaces 30, 32 in uncompressed state. In the preferred embodiment shown, W is about 0.040 inch, T is about 0.010 inch, and L is about 0.160 inch, including the curved segments of radius, R, e.g., about 0.012 inch. The contact pad engagement surfaces 26, 28, exposed on the tabs, are of area C by W, e.g., about 0.030 inch by 0.040 inch.

Disposed above and below area array connector arrangement 12 are circuit boards 14, 16 having board surfaces 15, 17 respectively opposed to connector array surfaces 30, 32. Disposed on the board surfaces are contact pads 34, 36, in the embodiment shown having thickness of about 0.001 inch, with a diameter of 0.050 inch on 0.100 inch centers.

When assembled (FIG. 3), each contact pad 34 of board 14 lies in electricity-conductive contact with the opposed contact pad engagement surface 26 of a interconnect element 22, which extends through the support member 13 to electricity-conductive contact between contact pad engagement surface 28 and contact pad 36 of the opposed circuit board 16. The pairs of contact pads connected via element 22 are offset from each other, and the element is configured in a manner to cause the element to move bodily in the support member as compressional force is applied to the opposed boards, as shown in FIG. 4, and described in more detail below.

Referring to FIG. 5, the circuit 10 is shown in assembled state, with area array connector 12 disposed between circuit boards 14, 16. Interconnect elements 22 extend through the support member 13, with contact pad engagement surfaces 26, 28 of tabs 27, 29 disposed in contact with contact pads 34, 36. The centers of the opposed contact pads to be electrically interconnected are offset from each other by a distance, D, e.g., about 0.120 inch, and the undersurfaces of tabs 27, 29 lie generally on the respective planar surfaces 30, 32 of the support member 13.

Referring to FIG. 5*a*, upon application of compression force to the opposed boards, represented by arrows, P, the gap between board surfaces 15, 17 is decreased to distance, G, equal to about 100% down to about 60% of W, the uncompressed thickness of the support member 13, e.g., in the embodiment shown, G is about 0.100 inch. The combination of the structure of the interconnect elements 22, the relationship of the elements to the material of the surrounding support member matrix, and the angle of the line projected through the contact pad engagement surfaces of the interconnect element at the time of their initial engagement upon the contact pad surfaces causes the interconnect elements to move bodily within the support member by rotation, e.g. about axes, X, on the support member center-line to a greater acute angle, M', without significant flexing of the interconnect element. The cellular, open nature of the foam of support member 13 allows the member to give resiliently by movement of elastomeric material into the foam voids, without significant adverse affect on the position of surrounding adjacent interconnect elements. As the interconnect element rotates, the contact pad engagement surfaces also move along the opposed surfaces of the contact pads, indicated by arrows, S, over a distance, E, in a wiping action that removes oxides, dust particles and the like from the contacting surfaces for improved electricity-conducting contact. (Where angle B is about 30°, the length, E, is typically about 0.016 inch.)

As mentioned, the interconnect elements rotate without significant flexing or deformation. As a result, when pressure, P, is removed, the resilience to return the conductor element to essentially its original position, as shown in FIG. 5, is provided entirely by the resilience of the support member.

In another embodiment, the connector arrangement, shown in FIGS. 6 and 6*a*, is a single, isolated interconnect element 22', having a body 24' lying generally perpendicular to the opposed board surfaces, with tabs 26', 28' extending outwardly, in opposite directions, parallel to the surfaces. Line, F, connecting points on the engagement surfaces of the interconnect element lies at an initial acute angle, M, to the direction of thickness of the support member. Upon application of compression force, P, to the opposed boards 14, 16, shown in FIG. 6*a*, the connector element 22. rotates bodily in aperture 41, compressing the support member 13 in the area adjacent and below the tabs to a reduced thickness state, with rotational movement of the interconnect element on the surface of the contact pad causing desirable wiping action of length, E, e.g., about 0.025 inch, for improved electrical contact. (In the embodiment shown, the final gap thickness, G, is approximately equal to the uncompressed thickness, A, of the support member, with compression of the support member to reduced thickness state being confined generally to the vicinity of the connector element.)

The positions of interconnect elements in the support member are predetermined, and apertures formed at precise locations, e.g., by numerically controlled drilling. The elements may also be cast in place, or the support member may be cast in a manner to provide apertures at the desired positions. Oval or even slit-form apertures may be provided, in order to more closely conform to the rectangular shape of the element, by forming the apertures, e.g., by drilling, while the support member is stretched, then allowing it to relax.

Other embodiments are within the following claims. For example, the support member may be an open cell foam or may be of other construction providing the desired voids, or, as shown in FIGS. 6 and 6*a*, the support member may include a sheet-form layer 40 of generally nondistendible material, e.g., Mylar® or woven fiberglass mat, in the embodiment shown, disposed along the center line between the surfaces of the support member to further minimize bulging of the material of the support member in the plane of the member under compressional force, thereby to reduce displacement of adjacent interconnect elements from the desired positions. The Mylar® film may also be disposed upon support member surfaces 30, 32, the modulus of the material of the film allowing application of higher compressional force without adversely affecting performance of the connector arrangement, and also permitting adjustment of the coefficient of thermal expansion of the connector arrangement.

Also, the interconnect element may be a sheet form member (122, FIGS. 7 and 7*a*) or a round or a rectangular pin (222, FIG. 8; 322, FIG. 9, respectively) without tabs, the body of the interconnect element lying at an acute angle to the direction of thickness of the support member, with contact pad engagement surfaces disposed at each end. Referring to FIG. 7*a*, as compressional force, P, is applied to the opposed circuit boards, the interconnect element 122 bodily rotates to a greater acute angle with the engagement surfaces wiping the contact pad surfaces for improved conductivity. Also as shown in FIGS. 8 and 9, the interconnect elements may be provided with support-member-engaging rings (42, FIG. 8) or protrusions (44, FIG. 9) to retain the pin placement within the support member, and the elements may be placed by insertion through the support member.

In another embodiment, shown in FIGS. 10, 10*a* and 10*b*, the interconnect element may be bent three dimensionally to cause the lines of projection of the tabs to be in different planes normal to the direction of thickness of the support member, whereby the member is caused to twist as it rotates bodily upon application of compressional force to the opposed boards, thereby providing oblique or rotational wiping of the engagement surfaces on the opposed contact pad surfaces. FIG. 10 shows a side view of one possible three-dimensional interconnect element, while FIGS. 10*a* and 10*b* show alternate rear views of such interconnect element configurations.

In a further embodiment for controlled impedance connection, shown in FIGS. 11 and 11*a*, the support member so may include a conductive grounded layer 52, e.g., of foam, disposed between two layers of nonconductive elastomeric material 54, 56, also typically foam, to form a ground plane. The body 58 of the interconnect element is coated first with a layer of dielectrical material and then coated with a metal outer layer 64. The protruding tabs (66, FIG. 11*a*) ensure connection between the conductive foam layer 52 and the metal outer layer of the interconnect element.

What is claimed is:

1. An area array connector device for providing electrical interconnection between a plurality of first contact pads arranged on a surface of a first circuit board and a plurality of corresponding second contact pads on an opposed surface of a second opposed circuit board, said area array connector device comprising an electrically nonconductive support member adapted to be disposed between the circuit boards and comprising resilient elastomeric foam material defining a distribution of voids, said support member having support surfaces to be respectively opposed tot he surfaces of the first and second circuit boards and being adapted to be compressed by urging of the circuit boards together, and a plurality of bodily-rotatable, electrically conductive interconnect elements, each comprising a body extending generally in the direction of the thickness of the resilient elastomeric foam support member and tab portions projecting angularly from the respective ends of said body, said element defining a pair of pad engagement surfaces disposed to engage the respective corresponding contact pads, a line projected through said engagement surfaces being disposed at an initial, acute angle to the direction of thickness of said support member, and said tab portions defining engagement surfaces disposed at least closely in opposition to said support surfaces of said support member to engage upon said support surfaces during bodily rotation of said interconnect element to locally compress the elastomeric foam of said support member, whereby, when said area array connector device is disposed between the circuit boards in a clamped-together relationship with said interconnect elements in registry with their respective corresponding contact pads and with said interconnect elements rotated bodily as a result of said clamping so that said line projected through said pad engagement surfaces of each element lies at an acute angle resiliently supported by said elastomeric foam to bear with force upon the contact pads, and said voids of said elastomeric foam of said support member serve locally to accommodate bodily rotation of said interconnect elements in a manner avoiding disturbance of adjacent elements whereby displacement of the elastomeric foam material of said support member about each said interconnect element is limited generally to the local region of said element.

2. The area array connector device of claim 1 wherein a set of adjacent of said interconnect elements are disposed for bodily rotation in a common plane.

3. The area array connector device of claim 2 wherein the contact pads on said first circuit board and the corresponding contact pads on said second circuit board are arranged in a high density.

4. The area array connector device of claim 3 wherein said contact pads are arranged on centers of 0.100 inch spacing or less.

5. The area array connector device of claim 1 wherein said elastomeric foam has an aggregate void volume in the range of about 25 to 95%.

6. The area array connector device of claim 5 wherein said elastomeric foam has a void volume in the range of about 60 to 75%.

7. The area array connector device of claim 1 wherein said elastomer is selected from the group consisting of silicone, urethane, natural rubber, copolymers of butadiene-styrene, butadiene-acrylonitrile, butadiene-isobutylene, chloroprene polymers, polysulfide polymers, plasticized vinyl chloride polymers and copolymers, and plasticized acetate polymers and copolymers.

8. The area array connector device of claim 1 wherein said support member has a compression force deflection (CFD) in the range of about 2 to 50 pounds per square inch at 25 percent compression.

9. The area array connector device of claim 1 wherein said support member has a compression set of less than about ten percent after 22 hours at 158° F. at 50 percent compression with one half hour recovery.

10. The area array connector device of claim 1 wherein said support member further comprises a sheet-form layer of generally non-distendible material disposed generally parallel to said opposed board surfaces.

11. An electrical circuit assembly comprising an area array connector device, and first and second circuit boards, said first circuit board having a first surface with a plurality of first contact pads arranged thereon and said second circuit board having a second surface, opposed to said first surface, with a plurality of corresponding second contact pads arranged thereon, said area array connector device comprising an electrically nonconductive support member disposed between said circuit boards and comprising resilient elastomeric foam material defining a distribution of voids, said support member having support surfaces respectively opposed to the first and second surfaces of said first and second circuit boards and said support member adapted to be compressed by urging of said circuit boards together, and a plurality of bodily-rotatable, electrically conductive interconnect elements, each comprising a body extending generally in the direction of the thickness of the resilient elastomeric foam support member and tab portions projecting angularly from the respective ends of said body, said element defining a pair of pad engagement surfaces disposed to engage the respective corresponding contact pads, a line projected through said engagement surfaces being disposed at an initial, acute angle to the direction of thickness of said support member, and said tab portions defining engagement surfaces disposed at least closely in opposition to said support surfaces of said support member to engage upon said support surfaces during bodily rotation of said interconnect element to locally compress the elastomeric foam of said support member, said area array connector device disposed between said circuit boards in a clamped-together relationship with said interconnect elements in registry with their respective corresponding contact pads and with said interconnect elements rotated bodily as a result of said clamping so that said line projected through said pad engagement surfaces of each element lies at an acute angle greater than said initial angle, the interconnect elements being resiliently supported by said elastomeric foam to bear with force upon the contact pads, and said voids of said elastomeric foam of said support member serving locally to accommodate bodily rotation of said interconnect elements in a manner to avoid disturbance of adjacent elements whereby displacement of the elastomeric foam material of said support member about each said interconnect element is limited generally to the local region of said element.

12. The electrical circuit assembly of claim 11 comprising said area array connector device wherein said elastomeric foam has an aggregate void volume in the range of about 25 to 95%.

13. The electrical circuit assembly of claim 11 comprising said area array connector device wherein said elastomeric foam has a void volume in the range of about 60 to 75%.

14. The electrical circuit assembly of claim 11 comprising said area array connector device wherein said elastomer is selected from the group consisting of silicone, urethane, natural rubber, copolymers of butadiene-styrene, butadiene-acrylonitrile, butadiene-isobutylene, chloroprene polymers, polysulfide polymers, plasticized vinyl chloride polymers and copolymers, and plasticized acetate polymers and copolymers.

15. The electrical circuit assembly of claim 11 comprising said area array connector device wherein said support member has a compression force deflection (CFD) in the range of about 2 to 50 pounds per square inch at 25 percent compression.

16. The electrical circuit assembly of claim 11 comprising said area array connector device wherein said support member has a compression set of less than about ten percent after 22 hours at 158° F. at 50 percent compression with one half hour recovery.

17. The electrical circuit assembly of claim 11 comprising said area array connector device wherein said support member further comprising a sheet-form layer of generally non-distendable material disposed generally parallel to said opposed board surfaces.

18. The electrical circuit assembly of claim 11 comprising said area array connector device wherein a set of adjacent of said interconnect elements are disposed for bodily rotation in a common plane.

19. The electrical circuit assembly of claim 11 comprising said area array connector device wherein the contact pads on said first circuit board and the corresponding contact pads on said second circuit board are arranged in a high density.

20. The electrical circuit assembly of claim 11 comprising said area array connector device wherein said contact pads are arranged on centers of 0.100 inch spacing or less.

* * * * *

UNITED STATES PATENT AND TRADEMARK OFFICE

CERTIFICATE OF CORRECTION

PATENT NO. : 4,793,814

DATED : December 27, 1988

INVENTOR(S) : Mark S. Zifcak, et al.

It is certified that error appears in the above-identified patent and that said Letters Patent is hereby corrected as shown below:

| | |
|---|---|
| Column 3, Line 11: | "an 0.500" should be --and 0.500-- |
| Column 5, Line 17: | "22." should be --22'-- |
| Column 6, Line 43: | "tot he" should be --to the-- |
| Column 7, Line 3: | Insert before "resiliently" the following: --greater than said initial angle, the interconnect elements are-- |
| Column 8, Line 62: | "comprising" should be --comprises-- |

Signed and Sealed this

Eleventh Day of July, 1989

*Attest:*

*Attesting Officer*

DONALD J. QUIGG

*Commissioner of Patents and Trademarks*